US007191788B2

(12) United States Patent
Holub et al.

(10) Patent No.: US 7,191,788 B2
(45) Date of Patent: Mar. 20, 2007

(54) TENT WITH WINDOW HAVING AN INTERNAL SHELF

(75) Inventors: Timothy M. Holub, Cheney, KS (US); Ryan J. O'Donnell, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 234 days.

(21) Appl. No.: 10/794,845

(22) Filed: Mar. 5, 2004

(65) Prior Publication Data

US 2005/0194033 A1 Sep. 8, 2005

(51) Int. Cl.
*E04H 15/32* (2006.01)
*E04H 15/14* (2006.01)

(52) U.S. Cl. ..... 135/93; 135/115; 135/117; 135/119

(58) Field of Classification Search ..... 135/156, 135/117, 120.1, 120.3, 91, 93, 88.18, 115, 135/119, 87; 108/42, 46, 47; 296/169
See application file for complete search history.

(56) References Cited

U.S. PATENT DOCUMENTS

| | | | | | |
|---|---|---|---|---|---|
| 271,146 | A | * | 1/1883 | Stearns | 135/87 |
| 985,002 | A | | 2/1911 | Brown | |
| 1,124,263 | A | * | 1/1915 | Bemis | 135/117 |
| 1,512,962 | A | * | 10/1924 | Whall | 135/117 |
| 1,888,014 | A | * | 11/1932 | Powers | 135/117 |
| 2,027,491 | A | * | 1/1936 | Percy | 52/36.4 |
| 2,391,871 | A | * | 1/1946 | Benson | 135/117 |
| 3,143,121 | A | * | 8/1964 | McKee | 135/117 |
| 3,226,776 | A | * | 1/1966 | Wormer | 52/36.4 |
| 4,332,112 | A | | 6/1982 | Hsu | |
| 5,172,526 | A | | 12/1992 | Morgan | |
| 5,765,584 | A | | 6/1998 | Hesler et al. | |
| 5,794,385 | A | * | 8/1998 | Donovan | 52/36.4 |
| 5,813,160 | A | * | 9/1998 | Thoelke | 135/87 |
| 6,216,715 | B1 | | 4/2001 | Howe | |

(Continued)

FOREIGN PATENT DOCUMENTS

EP 0565497 A1 10/1993

(Continued)

OTHER PUBLICATIONS

Search Report by the Dutch Patent Office in corresponding patent application (Jul. 19, 2005).

(Continued)

*Primary Examiner*—Tamara L. Graysay
(74) *Attorney, Agent, or Firm*—Leydig, Voit & Mayer, Ltd.

(57) ABSTRACT

A tent having window shelf that extends into a tent from the bottom of a window opening. The shelf may be formed, for example, by an inner covering of the window. The inner covering may include an outer support such as a pole so that it may maintain its configuration when folded down, and a fabric strip or other structure for maintaining the inner covering in a horizontal position so that it may serve as a shelf. A clasp or a plurality of clasps may be provided for attaching an inner covering of a tent window and permitting the inner covering to drape over the opening for the window without completely closing the opening.

8 Claims, 3 Drawing Sheets

U.S. PATENT DOCUMENTS

| | | | | |
|---|---|---|---|---|
| 6,679,009 | B2 * | 1/2004 | Hotes | 135/117 |
| 6,840,254 | B1 * | 1/2005 | Windham | 135/117 |
| 6,901,727 | B2 | 6/2005 | Kramer et al. | |
| 2002/0104841 | A1 | 8/2002 | Choi | |

FOREIGN PATENT DOCUMENTS

| | | | |
|---|---|---|---|
| FR | 2082681 | A | 12/1971 |
| JP | 6-66053 | A * | 3/1994 |

OTHER PUBLICATIONS

Search Report by the French Patent Office in corresponding patent application (Mar. 1, 2006).

* cited by examiner

TENT WITH WINDOW HAVING AN INTERNAL SHELF

TECHNICAL FIELD OF THE INVENTION

The present invention generally relates to tents, and more particularly to tent construction.

BACKGROUND OF THE INVENTION

Tents are portable shelters made of lightweight, often waterproof, fabrics. Typically, a tent is a collapsible shelter of canvas or other material stretched over and sustained by a frame. Tents are used for camping outdoors, or as temporary structures. Tents come in a variety of shapes, including dome and cabin tents.

One problem with contemporary tents is that they very often lack storage. For the most part, a tent includes walls and a floor, and anything stored in the tent must be kept on the floor. Placing items on the floor can create clutter, and may result in damage if a user steps on or kicks an item on the floor.

Some tents have pouches or pockets mounted on the inside of the walls for the tent. In addition, some family or cabin style tents include a grommet or another attachment structure to which a hanging organizer may be attached. Although these prior are solutions provide some storage options, there exists a need for additional storage in a tent.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a clasp or a plurality of clasps are provided for attaching an inner covering of a tent window and permitting the inner covering to drape over the opening for the window without completely closing the opening. This feature permits the inner covering to block a large portion of the window, restricting the ability of anyone outside the tent to see into the tent, but still allows the window to provide ventilation.

In accordance with an embodiment, the inner covering is connected by toggle and loop fasteners. However, other clasps or connection mechanisms may be used. If desired, a screen may also be provided for the window opening and the inner covering may partially cover the screen.

In accordance with an embodiment, a window shelf is provided that extends into a tent from the bottom of the opening for the tent. The shelf may be formed, for example, by an inner covering of the window. The inner covering may include an outer support such as a pole so that it may maintain its configuration when folded down, and a fabric strip or other structure for maintaining the inner covering in a horizontal position so that it may serve as a shelf.

If desired, screens may be provided that extend between the outer edges of the inner covering and the upper edges of the window opening when the window opening is in the shelf position. An outer window covering may cover the window opening and may be accessed by opening the screens.

The window shelf provides an opening for allowing ventilation into the tent, and also a device for storage of items within the tent. Because the shelf is spaced from the ground, a user may sleep under the shelf or may place other items under the shelf. In addition, if the outer window covering is opened, a user may place items on the shelf from outside the tent. The same user or a different user may then access these items by opening the screen on the inside of the tent.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
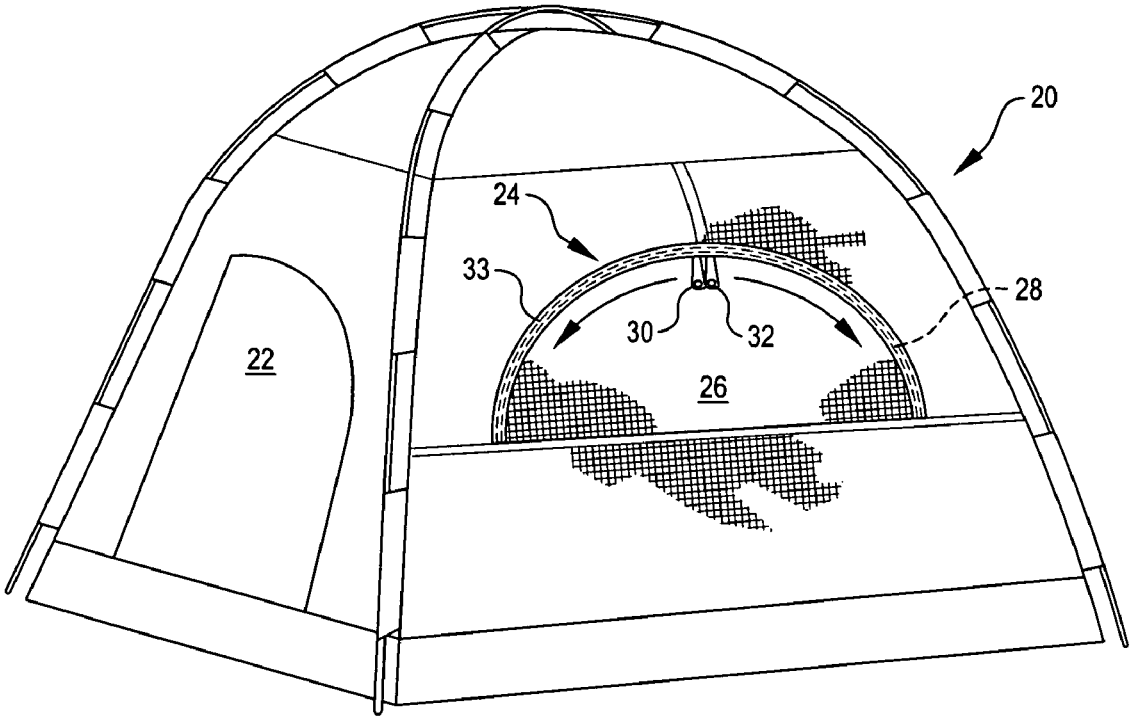
FIG. 1 is a side perspective view of a tent incorporating an embodiment of the invention.

Referring now to the drawings, in which like reference numerals represent like parts throughout the several views, FIG. 1 shows a tent 20 embodying the present invention. The tent 20 shown in the drawings is a "dome" style tent, although features of the invention may be used in different models of tents, whether dome, free standing, cabin, or other models. Thus, although described with reference to the tent 20, the invention may be utilized with many different tent structures and could be used in fabric structures other than tents, such as shelters.

The tent 20 includes a door 22 and a window opening 24. Briefly, in accordance with an embodiment, the window opening 24 is configured and arranged so that it may be altered between a closed window position, shown in FIG. 2, to a shelf position, shown in FIGS. 4 and 5. Also, in accordance with another embodiment, clasps are provided that may hold the window 24 in a partially open configuration, as shown in FIG. 3. Each of these embodiments is further described below.

The window opening 24 in the drawings is shaped like a semi-circle, but other configurations of a window may be used. The window opening 24 includes an outer window covering 26, as can be seen in FIG. 1. The outer window covering 26 is attached to the tent 20 by a zipper 28, in the embodiment shown having two zipper pulls 30, 32. A flap 33 extends over the zipper 28 to provide rain protection.

Figure 2:
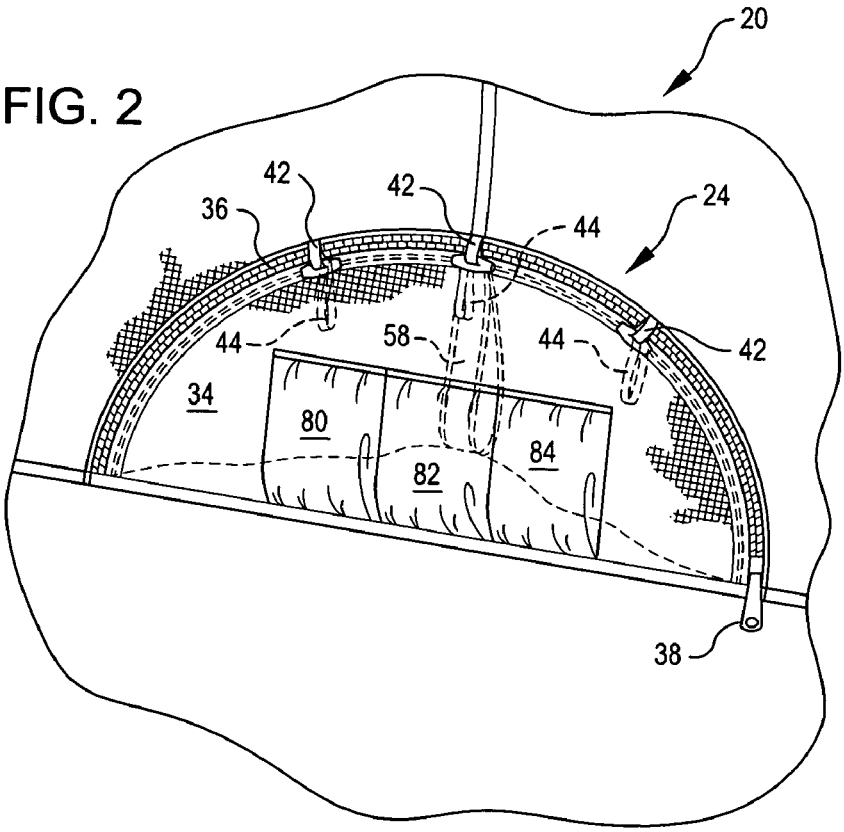
FIG. 2 is a side perspective view of an inside of a window for the tent of FIG. 1.
Figure 3:
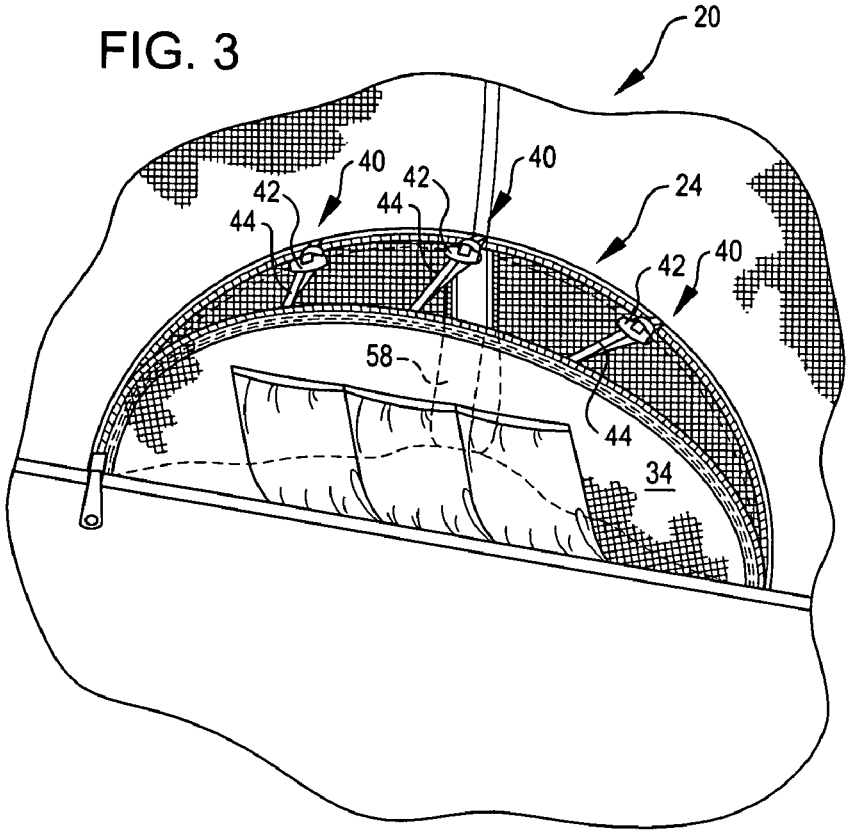
FIG. 3 is a side perspective view of the window of FIG. 2, with the window partially opened.

As can be see in FIG. 2, the window opening 24 is also covered by an inner covering 34. The inner covering 34 is attached to the tent 20 by a zipper 36 having a zipper pull 38.

Turning now to FIG. 3, in accordance with an embodiment, clasps 40 are provided for holding the inner covering 34 in a partially opened position. In the embodiment shown, the clasps 40 include toggles 42 attached above the window opening 24 and loops 44 attached at the upper edge of the inner covering 34. Other clasps may be used, for example, ties, hook and loop fasteners, buttons, snaps, clips, clamps, or other devices that can be used to connect and space a portion of the inner covering 34 from a portion of the perimeter of the window opening 24.

In the embodiment shown, three clasps 40 are used. However, any number from one to more than three may be used to connect and space a portion of the inner covering 34 from a portion of the perimeter of the window opening 24.

The clasps, such as the clasps 40, may be utilized to provide partial ventilation through the window opening 24 but still position the inner covering 34 so that most views through the window opening 24 are blocked. For many prior art tents, if an individual desires to be inside the tent for any purpose, such as changing clothes or resting, and doesn't want people outside the tent to see into the tent, an inner covering 34 or other window cover must be zipped closed. This closing of the window opening 24 blocks air ventilation through the window opening 24. However, the clasps 40 of the present invention, because they keep the inner covering 34 attached yet separated from the perimeter of the window opening 24, still provide ventilation around and over the perimeter of the inner covering 34 but also permit the inner covering 34 to restrict viewing into the tent.

The clasps 40 may be used with any window having a covering. As an example, a window may have a screen and an inner covering (such as, but not limited to, the inner covering 34) with clasps, such as the clasps 40. In general, however, the clasps are useful when another mechanism is used to close the inner covering, such as a zipper. In this manner, the clasps serve as an alternate for supporting the inner covering. However, in accordance with an alternate embodiment, the zipper or other primary closure mechanism may be utilized in conjunction with the clasps, for example by attaching the clasps to the zipper.

Figure 4:
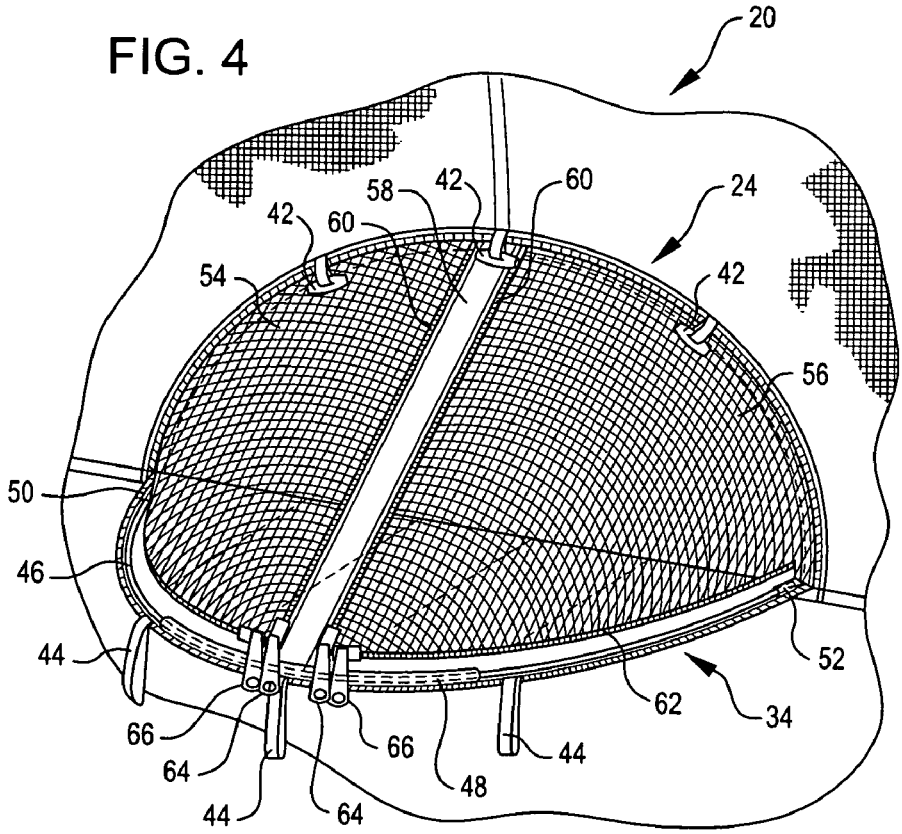
FIG. 4 is a side perspective view of the window of FIGS. 2 and 3, with the window fully opened to a shelf configuration.

In accordance with an embodiment, the inner covering 34 may be folded down to the position shown in FIG. 4 so that the inner covering 34 acts as a shelf. To assure a stable surface, a structure may be provided that maintains the shape of the inner covering 34 when the inner covering 34 is folded down to the position of FIG. 4. In the embodiment shown, a semi-circular pole 46 is mounted along an outer edge of the inner covering 34. As further described below, the pole 46 is preferably mounted after setting up the tent 20 so that the pole 46 does not interfere with folding and storage of the tent 20. The pole 46 extends through a sleeve 48 on the top edge of the inner covering 34, and is seated in fabric sockets 50, 52 at the outer edges of the base of the inner covering 34. Another suitable structure may be provided for attaching the pole 46. In addition, other structures may be arranged to provide structure for the inner covering 34, such as additional or alternate poles. As an example, a series of poles may extend radially to provide support for the inner covering 34. In addition, a series of poles may extend vertically along the back of the inner covering 34.

In an embodiment, screens 54, 56 extend between the upper edge of the window opening 24 and the upper edge of the inner covering 34 and a centrally-located fabric strip 58 when the inner covering 34 is in the lowered position shown in FIG. 4. The screens 54, 56 provide protection from bugs and other insects, and are attached along the fabric strip 58 by zippers 60 and along the outer edge of the inner covering 34 by additional zippers 62. Zipper pulls 64, 66 are provided for each of the zippers 60, 62, respectively. During operation, a user may grasp the zipper pulls 64, 66 and unzip the zippers 60, 62 so that the screens 54, 56 are detached from the fabric strip 58 and the inner covering 34. The screens 54, 56 may then be tied back, for example by straps 70 (FIG. 5).

Figure 5:
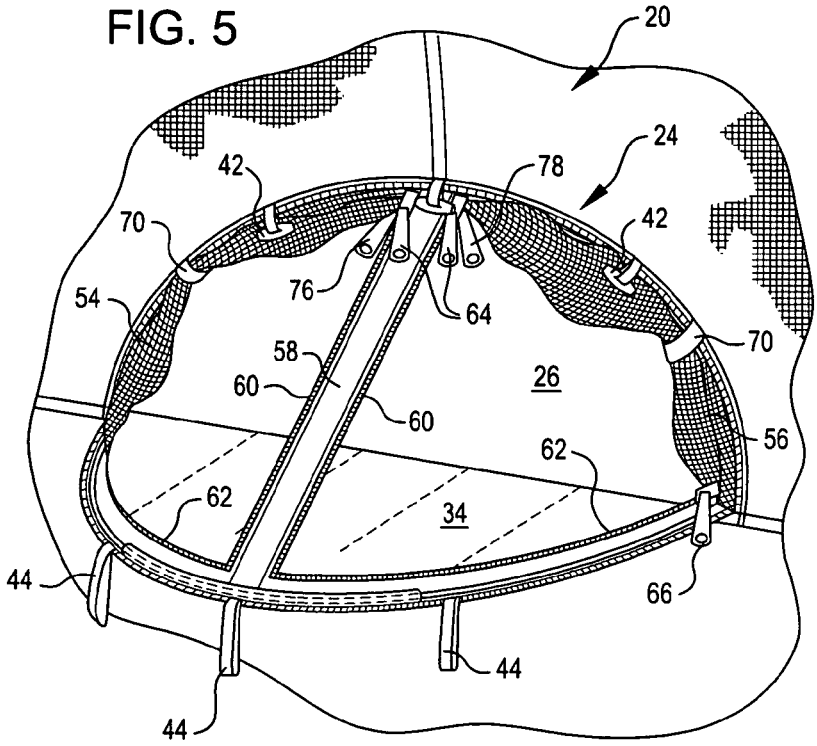
FIG. 5 is a side perspective view of the window of FIG. 4, with a screen for the window unzipped.

The fabric strip 58 extends from a top of the window opening 24 to an outer edge of the inner covering 34, and provides support for the inner covering 34 when in the position of FIGS. 4 and 5. That is, the fabric strip 58 is in tension and is supported at its upper end by its attachment to the upper edge of the window opening 24. When the inner covering 34 is in the lowered position shown in FIGS. 4 and 5, the fabric strip 58 is in tension, and prevents further rotation downward of the outer portion of the inner covering 34. In this manner, the fabric strip 58 and the inner covering 34 provide a supported shelf that extends horizontally. If desired, other structures may be used for supporting the inner covering 34 in the horizontal configuration. However, the particular embodiment described is convenient in that the fabric strip 58 may be folded between the inner covering 34 and the outer window covering 26 when the inner covering 34 is completely closed, as can be see in phantom in FIG. 2. In addition, the fabric strip 34, because it is made of fabric, is easily folded with the rest of the tent 20 for storage or transportation.

In accordance with an embodiment, the outer window covering 26 includes additional zipper pulls 76, 78 (FIG. 5) for unzipping the zipper 28 and that are accessible from the inside of the tent 20. These zipper pulls 76, 78 may be reached, for example, when the screens 54, 56 are in the folded configurations shown in FIG. 5.

In practice, a user sets up the tent 20. If the user previously closed the inner covering 34 on the last use, the inner covering 34 will be in the configuration shown in FIG. 2. The user may then unzip the zipper 36 and lower the inner covering 34 to the position shown in FIG. 4. At this time, the inner covering 34 will not have significant structural support. The pole 46 may be inserted to provide this support. For example, the pole 46 may be inserted through the sleeve 48, and into a first one of the fabric sockets 50, 52, and then may be tensioned and inserted into the second of the fabric sockets 50, 52. Thus, the pole 46 is placed in tension, and holds the outer portion of the inner covering 34 into position.

Figure 6:
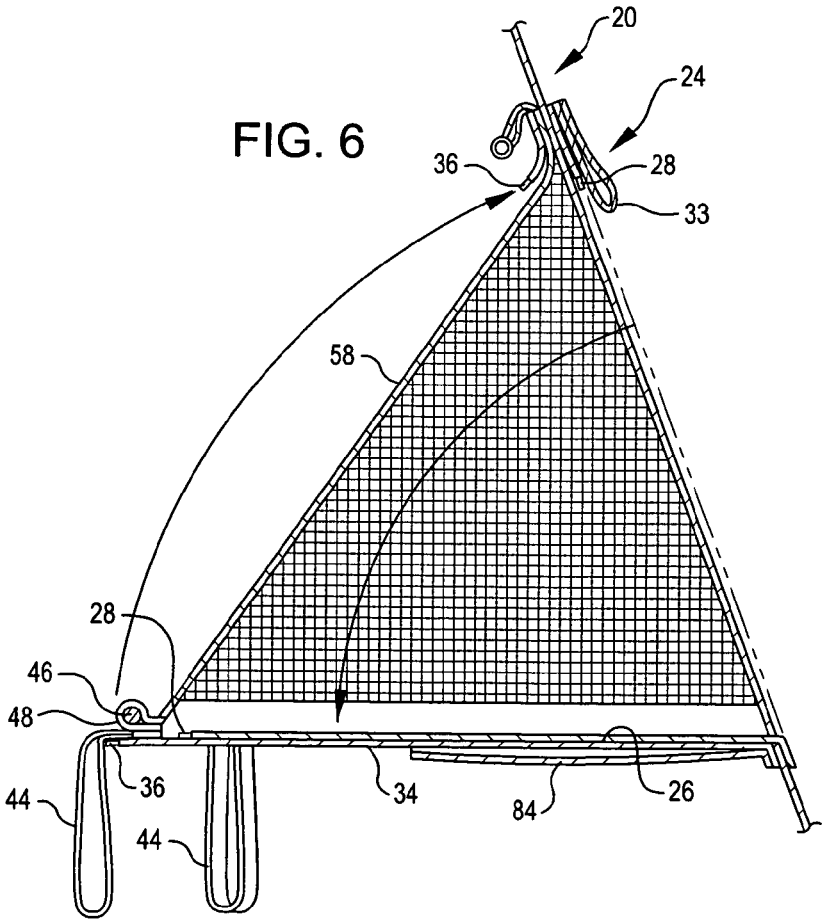
FIG. 6 is a side cut-away view of the window shown in FIG. 5.

As described above, the fabric strip 58 prevents further rotation downward of the inner covering 34, and thus the pole 46, the inner covering 34, and the fabric strip 58 provide a horizontally positioned shelf within the tent 20. A user inside the tent 20 may access the shelf by unzipping the zippers 60, 62 on the screens 54, 56. Unzipping the screens 54, 56 exposes the shelf as is shown in FIG. 5. A user also then has access to the zipper pulls 76, 78, which the user may use to open the outer window covering 26. The outer window covering 26 may be laid flat against the top of the inner covering 34, as is shown in FIG. 6, or may be rolled downward and out of the way. After the outer window covering 26 has been opened, the user may again close the screens 54, 56, to provide insect protection for the inside of the tent 20. As such, ventilation for the tent 20 is provided through the window opening 24.

When the outer window covering 26 is opened, a user has access to the shelf provided by the inner covering 34 from outside the tent 20. The user may place an item on the shelf so that it may later be grabbed by the user while in the tent

20, or may be grabbed by another user already in the tent. If the outer window covering 26 is closed, the user outside the tent may grab the zipper pulls 30, 32 and open it so as to gain access to the shelf.

In accordance with an embodiment, pouches 80, 82, 84 are provided on the outer surface of the inner covering 34. These pouches provide storage for items, such as watches and other small, valuable items. The pouches are arranged in an upright manner when the inner covering 34 is in the position shown in FIG. 2, and in a horizontal manner, under the inner covering 34, when the inner covering 34 is in the position shown in FIGS. 4, 5 and 6.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tent, comprising:

a window opening;

a shelf formed by an inner covering for the window opening and extending into the tent from a bottom of the window opening;

a structure for supporting the shelf, the structure comprising a fabric strip connected to the tent above the window opening and to the inner covering; and at least one screen attached to the inner covering, the fabric strip, and a perimeter of the window opening.

2. The tent of claim 1, wherein:

the fabric strip extends to an outer perimeter of the inner covering, the number of screens is at least two, and the screens extend along the outer perimeter of the inner covering.

3. The tent of claim 2, wherein the screens are configured to be opened to provide access to the shelf.

4. The tent of claim 2, further comprising an outer covering for closing the window opening, the outer covering being configured to be opened to provide access to the shelf.

5. A tent, comprising:

a window opening;

an inner covering configurable between a first arrangement in which the inner covering extends over the window opening and a second arrangement in which the inner covering serves as a shelf extending into the tent;

a structure for supporting the inner covering in the second arrangement, the structure comprising a fabric strip connected to the tent above the window opening and to the inner covering; and at least one screen attached to the inner covering, the fabric strip, and a perimeter of the window opening.

6. The tent of claim 5, wherein:

the fabric strip extends to an outer perimeter of the inner covering, the number of screens is at least two, and the screens extend along the outer perimeter of the inner covering.

7. The tent of claim 6, wherein the screens are configured to be opened to provide access to the shelf.

8. The tent of claim 6, further comprising an outer covering for closing the window opening, the outer covering being configured to be opened to provide access to the shelf.

* * * * *